US011253014B1

(12) United States Patent
Mosaddegh

(10) Patent No.: US 11,253,014 B1
(45) Date of Patent: Feb. 22, 2022

(54) FACIAL MASK WITH ADHESIVE-BACKED FILTERS IN SEPARATE NASAL PORTION AND ORAL PORTION

(71) Applicant: Lillie A. Mosaddegh, San Francisco, CA (US)

(72) Inventor: Lillie A. Mosaddegh, San Francisco, CA (US)

(73) Assignee: Lillie A. Mosaddegh, San Francisco, CA (US)

( * ) Notice: Subject to any disclaimer, the term of this patent is extended or adjusted under 35 U.S.C. 154(b) by 0 days.

(21) Appl. No.: 17/186,575

(22) Filed: Feb. 26, 2021

Related U.S. Application Data

(60) Provisional application No. 63/093,113, filed on Oct. 16, 2020, provisional application No. 63/130,134, filed on Dec. 23, 2020.

(51) Int. Cl.
*A41D 13/11* (2006.01)
*A62B 23/06* (2006.01)

(52) U.S. Cl.
CPC ..... *A41D 13/1176* (2013.01); *A62B 23/06* (2013.01)

(58) Field of Classification Search
CPC .. A41D 13/1176; A41D 13/1192; A61B 1/01; A61B 1/2676; A61B 1/2736; A61B 5/082; A61B 5/097; A61B 7/023; A61F 5/30; A61M 11/00; A61M 16/0057; A61M 16/0078; A61M 16/0461; A61M 16/0463; A61M 16/06; A61M 16/0605; A61M 16/0616; A61M 16/0622; A61M 16/0683; A61M 16/0688; A61M 16/0825; A61M 16/085; A61M 16/0875; A61M 16/105; A61M 16/12; A61M 16/125; A61M 16/16; A61M 2016/0661; A61M 2202/0208; A61M 2205/0205; A61M 2205/0238; A61M 2205/583; A61M 2230/432; A62B 18/08; A62B 23/06; B01D 2239/0442;

(Continued)

(56) References Cited

U.S. PATENT DOCUMENTS 4,240,420 A * 12/1980 Riaboy ..... A41D 13/1176 128/206.14
4,354,489 A * 10/1982 Riaboy ..... A41D 13/1176 128/206.14

(Continued)

*Primary Examiner* — Annette Dixon
(74) *Attorney, Agent, or Firm* — Philip H. Albert; Haynes and Boone LLP

(57) ABSTRACT

A two-part mask, having a nasal portion and an oral portion, can include adhesive to secure the nasal portion to the wearer's face. The adhesive might surround the nose to form a leakproof seal. An oral portion covering the wearer's mouth might include adhesive surrounding the mouth portion. Each mask portion could be worn separately. The nasal portion might be made from a filter material. The portions might be made in part from filter material and in part from transparent material. The transparent material might be positioned to allow for external viewing of the wearer's lip movements. The portions could be customizable to provide an anatomical fit for each individual wearer. The portions might be shaped to form a balloon shape, which can allow for movement of a mask portion from an extended position when the wearer is exhaling to a contracted position when the wearer is inhaling.

9 Claims, 7 Drawing Sheets

(58) Field of Classification Search
CPC ..... B01D 2239/045; B01D 39/2041; B01D 39/2072; Y10S 55/35
See application file for complete search history.

(56) References Cited

U.S. PATENT DOCUMENTS

| | | | | | |
|---|---|---|---|---|---|
| 5,003,633 | A * | 4/1991 | Itoh | A62B 18/025 | 128/206.21 |
| 5,161,523 | A * | 11/1992 | Gilbert | A61M 16/0048 | 128/202.28 |
| 6,196,223 | B1 * | 3/2001 | Belter | A41D 13/1176 | 128/205.25 |
| 8,365,734 | B1 * | 2/2013 | Lehman | A61M 16/12 | 128/206.28 |
| 8,960,195 | B2 * | 2/2015 | Lehman | A61M 16/125 | 128/206.28 |
| 2006/0150980 | A1 * | 7/2006 | Kim | B01D 39/2072 | 128/206.18 |
| 2019/0290874 | A1 * | 9/2019 | Baker | A61M 16/0057 | |

* cited by examiner

FACIAL MASK WITH ADHESIVE-BACKED FILTERS IN SEPARATE NASAL PORTION AND ORAL PORTION

CROSS-REFERENCE TO RELATED APPLICATIONS

The present application claims benefit, under 35 U.S.C. 119(e), of U.S. Provisional Application No. 63/093,113, filed Oct. 16, 2020 and U.S. Provisional Application No. 63/130,134, filed Dec. 23, 2020. Each of the foregoing applications are incorporated by reference in their entirety herein.

FIELD

The present disclosure generally relates to a mask and more particularly to mask usable to prevent transmission of pathogens to or from a wearer.

BACKGROUND

During pandemics and at other times, people might wear facial mask for extended periods. As a result, comfort, breathability, access to the face, visibility of lip movements and facial expressions, etc. are considerations. Many mask designs lack one or more of these features.

SUMMARY

A two-part mask, having a nasal portion and an oral portion, can include adhesive to secure the nasal portion to the wearer's face. The adhesive might surround the nose to form a leakproof seal. An oral portion covering the mouth of the wearer might include adhesive surrounding the mouth portion to form a leakproof seal. A wearer could wear just one or both parts of the mask.

The nasal portion might be made from a filter material. The oral portion might be made in part from filter material and in part from transparent material, or entirely opaque filter material or entirely transparent material. The transparent material might be positioned to allow for external viewing of the wearer's lip movements.

The mask portions could be customizable to provide an anatomical fit for each individual wearer and provide a complete seal. The mask portions might be shaped to form a balloon shape, which can allow for movement of a mask portion from an extended position when the wearer is exhaling to a contracted position when the wearer is inhaling.

The portions might be provided with optional openings, such as optional openings in the nasal portion to accommodate nasal prongs of oxygen tubing, and/or optional openings in the oral portion to accommodate drinking straws and the like.

Thicknesses of the filter material might vary.

BRIEF DESCRIPTION OF THE DRAWINGS

Various embodiments in accordance with the present disclosure will be described with reference to the drawings, in which.

DETAILED DESCRIPTION

Figure 1:
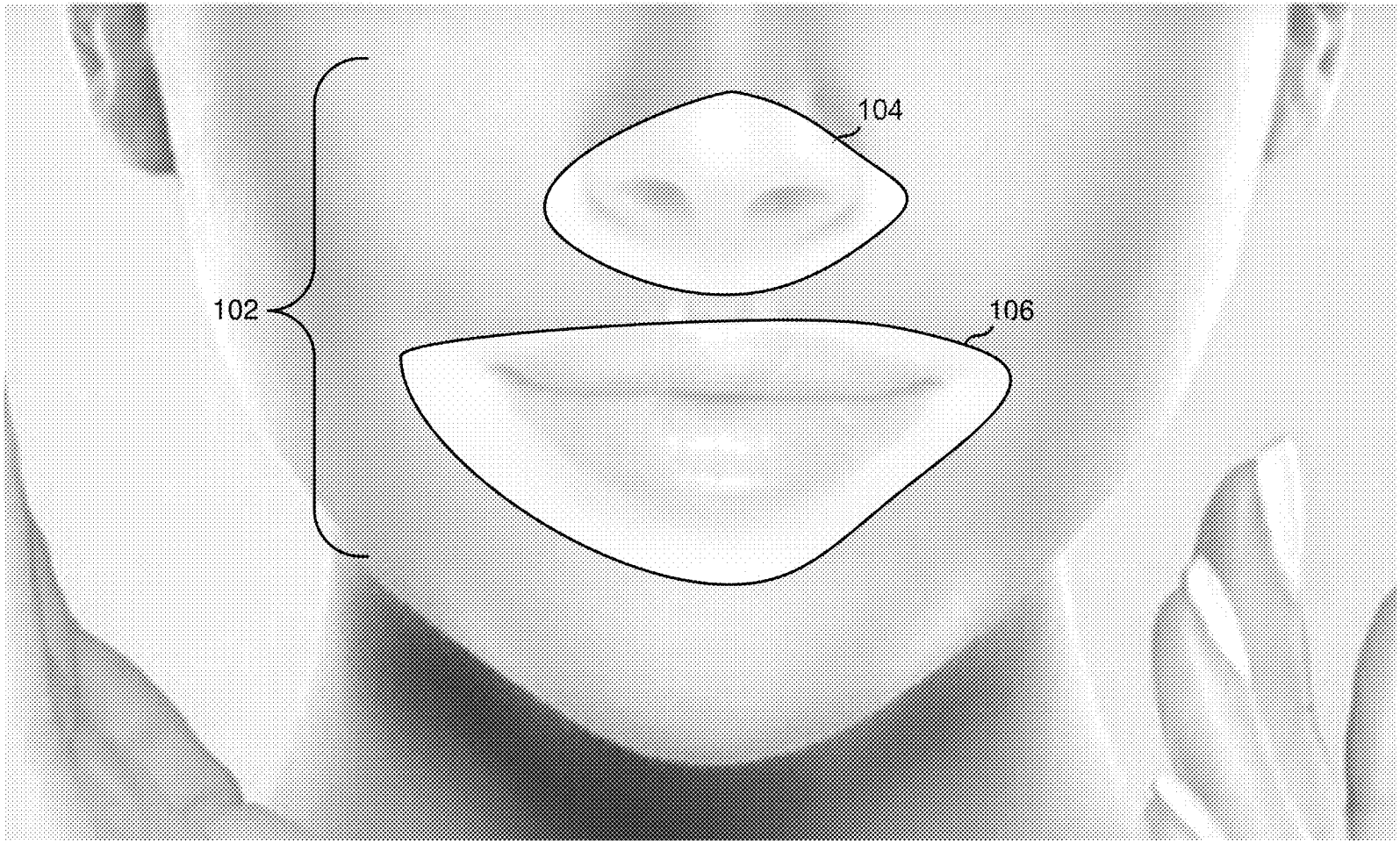
FIG. 1 is an illustration of a two-part mask according to embodiments.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

A two-part mask, having a nasal portion and an oral portion, can include adhesive to secure the nasal portion to the wearer's face. The adhesive might surround the nose to form a leakproof seal. An oral portion covering the mouth of the wearer might include adhesive surrounding the mouth portion to form a leakproof seal. A wearer could wear just one or both parts of the mask.

The nasal portion might be made from a filter material. The oral portion might be made in part from filter material and in part from transparent material, or entirely opaque filter material or entirely transparent material. The transparent material might be positioned to allow for external viewing of the wearer's lip movements. In some embodiments, the mask is largely transparent. In some embodiments, the mask is transparent in parts and opaque in others. In some embodiments, the mask is entirely opaque or is constructed from materials wherein transparency is not a concern.

The mask portions could be customizable to provide an anatomical fit for each individual wearer and provide a complete seal. The mask portions might be shaped to form a balloon shape, which can allow for movement of a mask portion from an extended position when the wearer is exhaling to a contracted position when the wearer is inhaling. With such balloon shapes around the mouth and the nose, the wearer might be able to breathe more easily and move their lips and speak more easily. A balloon-like shape for the nasal portion might allow for longer term use and breathability.

The oral portion might be manufactured with a plissé or crepe finish, which might facilitate speaking and communication during long-term use. The oral portion might be made from cotton fabric, possibly chemically treated, such that the fabric does not lay flat, but can crinkle. In other variations, it might be manufactured in a pleated fashion.

The portions might be provided with optional openings, such as optional openings in the nasal portion to accommodate nasal prongs of oxygen tubing, and/or optional openings in the oral portion to accommodate drinking straws and the like. In embodiments in which the nasal portion has openings for oxygen nasal prongs, those might be one or two round holes with adhesive around them to attach oxygen nasal prongs. In some embodiments, there are accommodations for attaching to portable oxygen sources and tanks to provide a fresh air environment for long-term use. This can be for wearers needing extra oxygen, contact sports players, and the public at large. The holes in the nasal portion and/or the oral portion can be resealable. In a specific embodiment, an additional, removable piece is provided that adheres to central holes and accommodates drinking straws for the mouth, easier breathing when in an isolated space where the wearer does not want to remove the entire oral portion. An example might be in an aircraft where the wearer is wearing the mask but there is an emergency that causes an oxygen masks to drop down. The wearer could open the optional holes before putting on the oxygen mask.

The oral portion can be made from opaque filter material, transparent filter material, transparent non-filtering material, or some combination as might be needed to provide some filtering and some transparency. The transparent material is positioned to allow for external viewing of the wearer's lip movements. Thicknesses of the filter material might vary. The filter material might be configured to allows for breathing while preventing or reducing aerosol distribution.

The adhesive used could comprise an adhesive strip that is flexible enough to fit the wearer's specific nose shape and mouth shape. In some embodiments, adhesive rings are separate from the mask portions and those adhesive rings can be applied once for multiple mask uses. In such embodiments, an overlying mask portion can be replaced without reapplying adhesives on the wearer's skin when changing masks. This could be useful for front-line workers, surgeons, healthcare providers, and public at large, where frequent mask replacement is required.

In various embodiments, the adhesive ring may include, in addition to and/or alternatively to adhesive that couples the overlying mask portion to the adhesive ring, one or more mask fasteners that are configured to couple to respective adhesive ring fasteners that are included on the overlying mask portion. For example, the one or more mask fasteners may include a ferromagnetic metal particle, a magnet, and/or other magnetic material that may generate an attractive magnetic force with the corresponding adhesive ring fastener on the overlying mask portion, which may include a ferromagnetic metal particle, a magnet, and/or other magnetic material. However, the one or more mask fasteners and the respective adhesive ring fasteners may include other fasteners such as clips, screws, hook- and loop-fasteners, and/or other fasteners for coupling or otherwise fastening the mask portions to respective adhesive rings.

In some embodiments, the mask portions have pockets for insertion of extra filters that can easily be placed, replaced, and removed without having to remove the mask portion itself. This can be useful for front-line workers as well as the general public in hot zones in a pandemic. Aside from pandemics, this could provide extra protection in polluted environments.

Comfort-related features might include the use of a mild adhesive so as not to irritate the wearer's skin. This could obviate the need for any metal pieces that might cause pressure marks or damage to the wearer's face as occurs with masks that use a metal portion to block upward warm airflow that can cause fogging of eye masks, glasses, etc.

In various embodiments, a two-part mask comprises a nasal portion and an oral portion, with the nasal portion for covering a wearer's nostrils being separate from oral portion for covering a wearer's mouth. Each can be adhered with adhesive.

In various embodiments, the two-part mask can do away with a need for ear or head straps, sparing ears, nose bridges, and large areas of facial skin from irritation, and can provide a tight, leak-proof seal for limiting pathogen transport out of the nose or mouth of the wearer and/or transport into the nose or mouth of the wearer. The filter material used can be effective for limiting transmission of coronaviruses, other viruses, pathogens, particulates, pollutants, and/or other materials. However, for wearers unable to apply adhesives to their skin, a strapped embodiment might be used.

The two-part construction and use of adhesive can reduce an amount of face coverage and can help separate nasal air from oral air. The adhesive approach can reduce skin irritations relative to a mask attached by straps. Being smaller than a face mask covering a large portion of the wearer's face, the two-part mask might be less obstructive for medical procedures, while still providing pathogen mediation. With a transparent oral portion, facial recognition and lip reading might be more easily performed.

The two-part mask might have broad, global application for a multitude of industries and functions, such as the medical field (operating rooms, procedure rooms, etc.), the aesthetic field (spas, salons, etc.), and/or the fashion industry (make-up visibility, accessories, customization, etc.), public use (schools, workplaces, social settings, gyms, restaurants, etc.).

The two-part mask might accommodate drinking/hydration without removal and might result in increased compliance due to comfort and look.

By separating nasal air and oral air, this might provide for isolation of exhaled air. The two-part mask might provide a targeted area of protection while mitigating concerns arising from larger facial coverage of conventional masks, including skin irritation, lack of facial recognition and lip reading, psychological effects, and sanitary issues. In some embodiments, the two-part mask can provide greater compatibility with oxygen delivery systems due in part to separation of the nasal cavity from the oral cavity.

In various embodiments, a two-part mask has a nasal portion and an oral portion, wherein the nasal portion includes a first adhesive applied to a first filter such that the first adhesive can form an enclosing seal on the facial surface enclosing a wearer's nostrils by the first filter and wherein the oral portion includes a second adhesive applied to a second filter such that the second adhesive can form an enclosing seal on the facial surface enclosing the wearer's mouth. The oral portion can be made in part from a filter material and in part from a transparent material, wherein the transparent material is positioned to allow for external viewing of the wearer's lip movements.

FIG. 1 is an illustration of a two-part mask 102 comprising a nasal portion 104 and an oral portion 106 according to embodiments. In various embodiments, the fabric and adhesive material used can be designed to prevent virus-rich aerosols.

In some embodiments, the inner lining of the mask portions and/or adhesive tape used for adhesive could be infused with antioxidants and vitamins for the skin. This might reduce or prevent skin irritations and/or provide treatment and enhancement to improve skin health.

Figure 2:
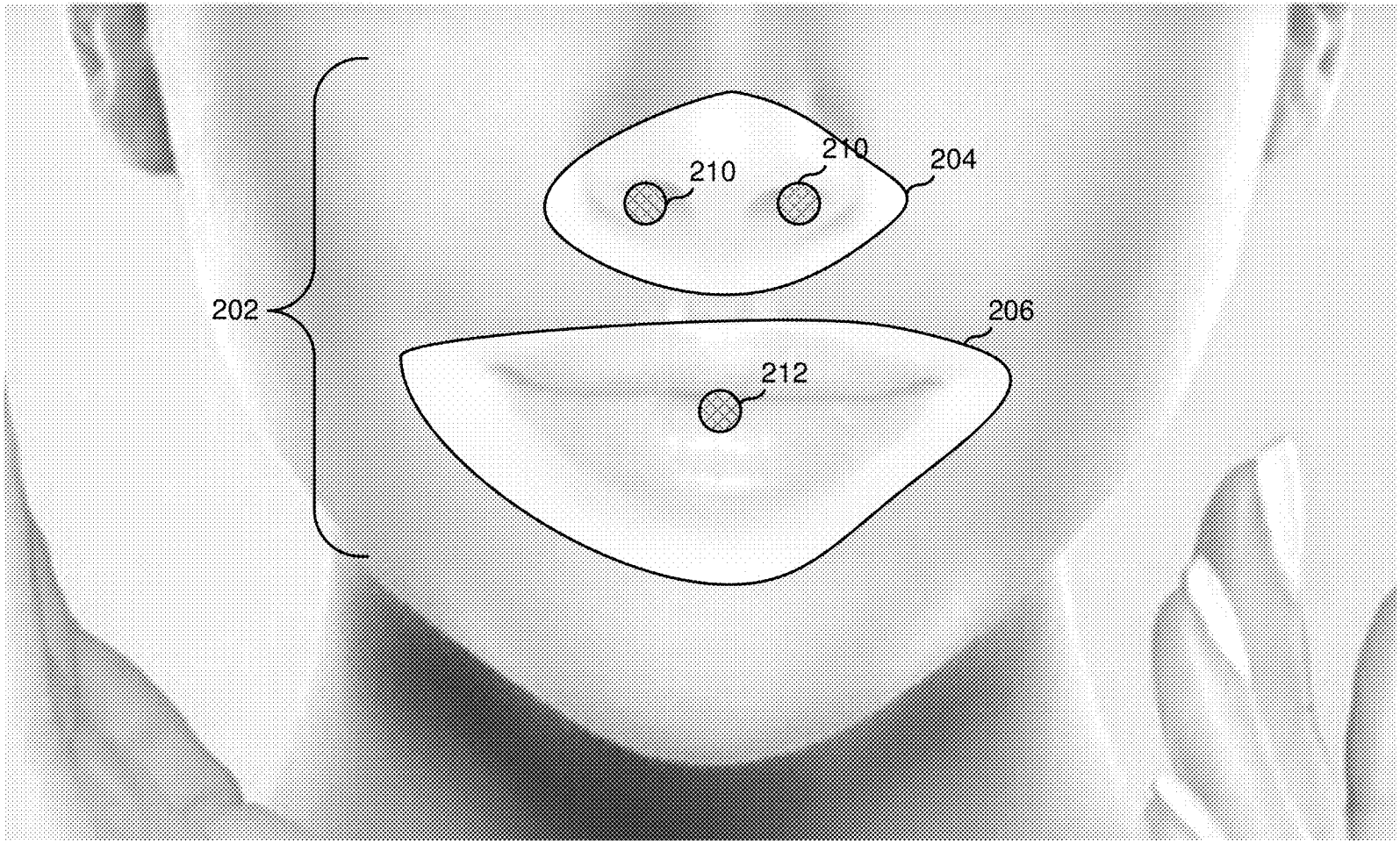
FIG. 2 is an illustration of an embodiment showing an example of placement of optional openings.

FIG. 2 is an illustration of an embodiment showing an example of placement of optional openings. As illustrated there, a two-part mask 202 comprising a nasal portion 204 and an oral portion 206 might include openings 210 in nasal portion 204 that allow for insertion of oxygen tubes or other nostril devices. Openings 210 might include a sealant for an airtight fit. A mouth opening 212 is also shown, which could also have a sealant and might be used to accommodate straws so that the wearer can remain hydrated without worry about leakage of aerosolized particles. This can be useful in recovery rooms, airplanes as well as more general settings.

Figure 3:
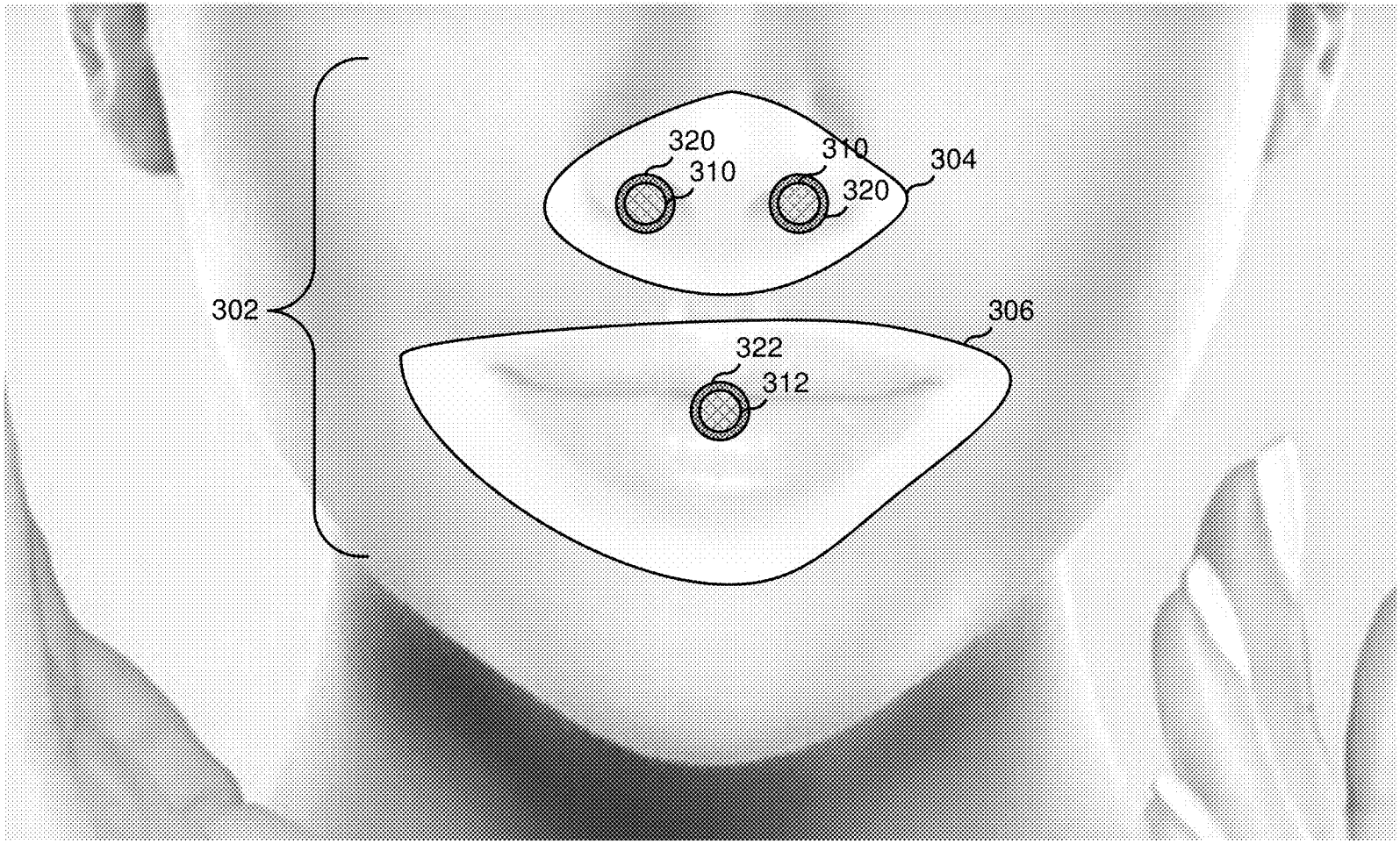
FIG. 3 is an illustration of an embodiment showing a variation having two conforming holes with sealant to allow for nasal insertions such as oxygen nasal prongs while addressing leakage, along with removable and reusable hole covers.

FIG. 3 is an illustration of an embodiment showing a variation having two conforming holes with sealant to allow for nasal insertions such as oxygen nasal prongs while addressing leakage, along with removable and reusable hole covers. As illustrated there, a two-part mask 302 comprising a nasal portion 304 and an oral portion 306 with openings 310 in nasal portion 304 and a mouth opening 312 is shown. Openings 310 and 312 might include removable adhesive hole covers 320, 322 that can be reapplied without having to remove or reapply the mask portions.

Figure 4:
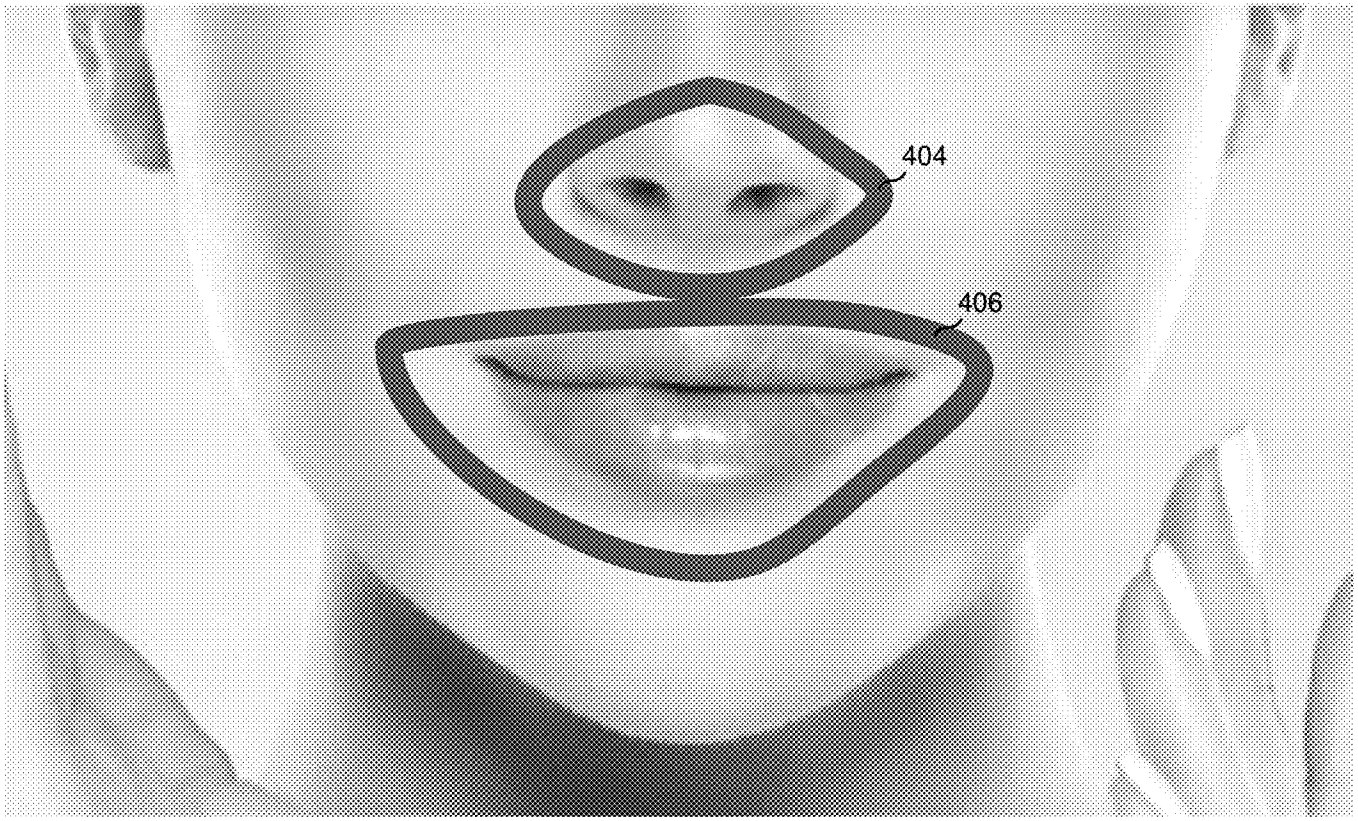
FIG. 4 is an illustration of an embodiment showing a variation that uses a separate adhesive band.

FIG. 4 is an illustration of an embodiment showing a variation that uses a separate adhesive band. The separate adhesive bands might allow for replacement of a filter portion of the mask portion without having to remove the adhesive band. As illustrated there, a nasal adhesive band 404 and an oral adhesive band 406 are shown applied to a wearer's face. The nasal adhesive band 404 and the oral adhesive band 406 might have a facial adhesive that is suitable for skin sensitivities on a side being applied to be proximate to the wearer's face and might have a hook-and-loop type adhesive element on a side that is distal from the wearer's face.

Figure 5:
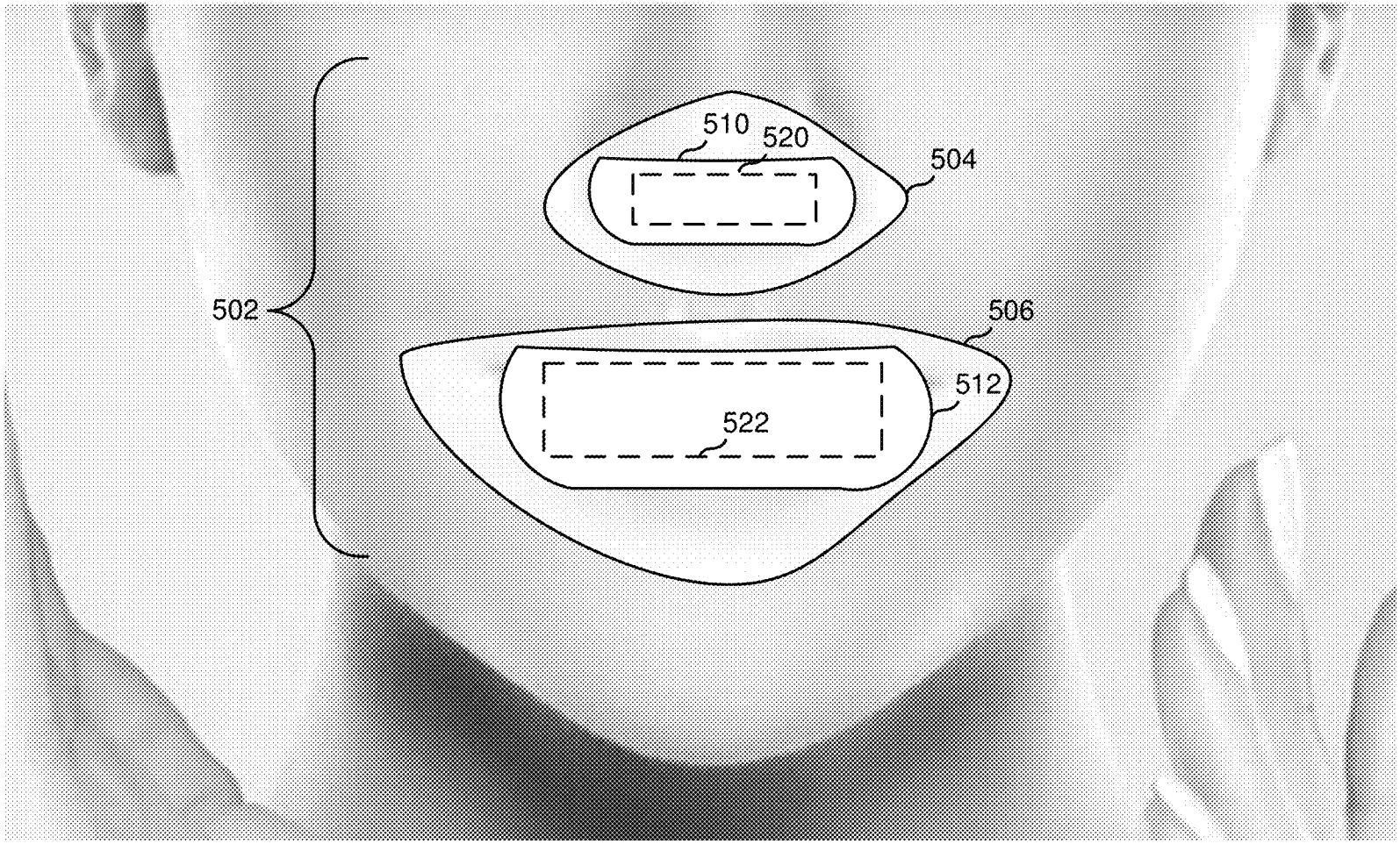
FIG. 5 is an illustration of an embodiment showing a variation that accommodates replaceable pocket filters.

FIG. 5 is an illustration of an embodiment showing a variation that accommodates replaceable pocket filters. As illustrated there, a two-part mask 502 comprises a nasal portion 504 having a pocket 510 and an oral portion 506 having a pocket 512 that allow for insertion of replaceable pocket filter materials 520 and 522 respectively.

Figure 6A:
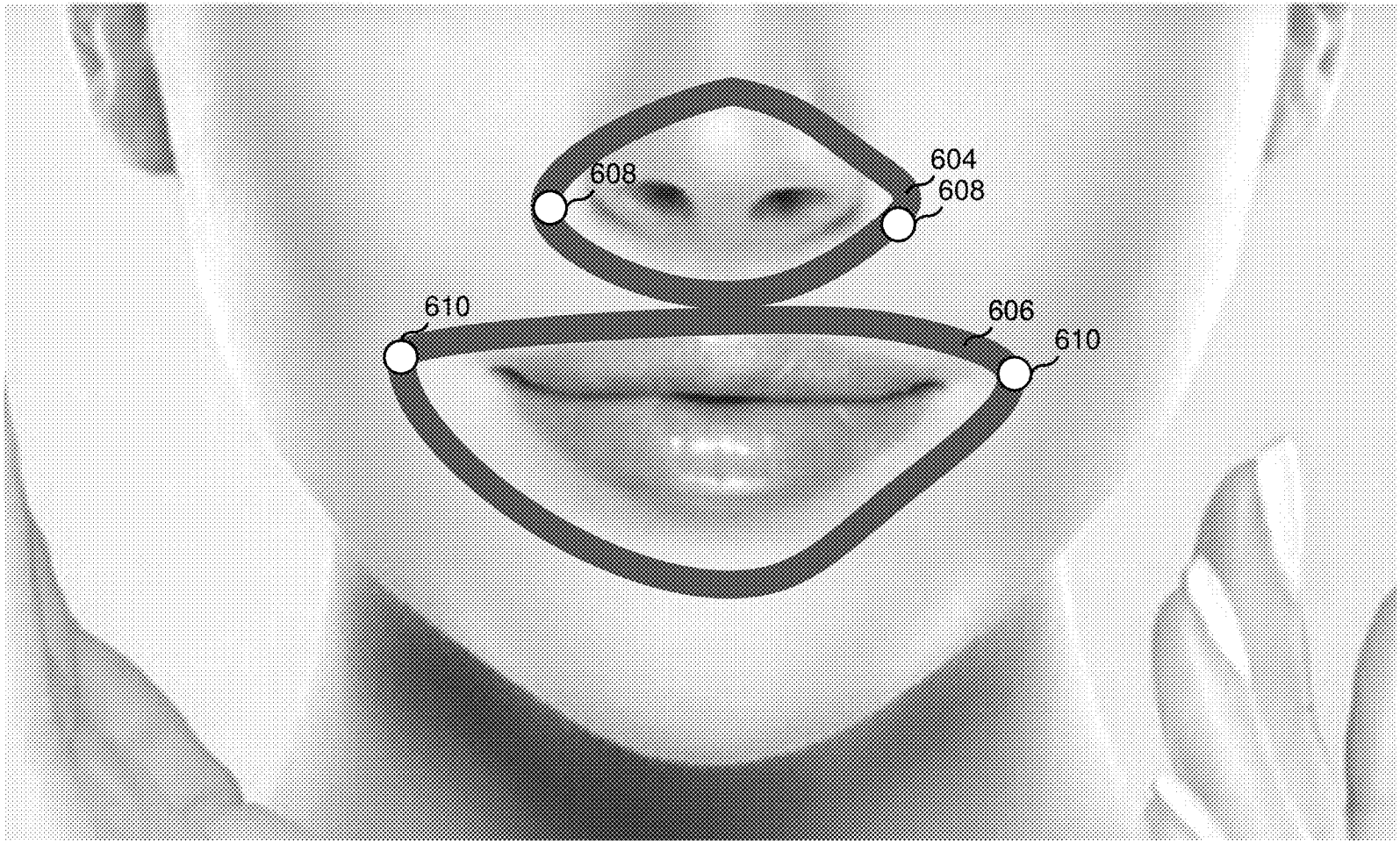
FIG. 6A is an illustration of an embodiment showing a variation of the separate adhesive band of FIG. 4 that includes a mask fastener for fastening and removing the two-part mask from the adhesive band.

FIG. 6A is an illustration of an embodiment showing a variation of the separate adhesive band of FIG. 4. As illustrated there, a nasal adhesive band 604 and an oral adhesive band 606 are shown applied to a wearer's face. In various embodiments, the nasal adhesive band 604 may include, in addition to and/or alternatively to the adhesive element that couples the respective mask portion to the nasal adhesive bands 604, one or more mask fasteners 608 that are configured to couple to respective adhesive band fasteners that are included on the overlying mask portion. Similarly, the oral adhesive band 606 may include, in addition to and/or alternatively to the adhesive element that couples the respective mask portion to the oral adhesive bands 606, one or more mask fasteners 610 that are configured to couple to respective adhesive band fasteners that are included on the overlying mask portion. For example, the one or more mask fasteners 608 and/or 610 may include a ferromagnetic metal particle, a magnet, and/or other magnetic material that may generate an attractive magnetic force with the corresponding adhesive ring fastener included on the overlying mask portion. However, the one or more mask fasteners may include other fasteners such as clips, screws, hook- and loop-fasteners, and/or other fasteners that couple to or otherwise fasten to corresponding adhesive band fasteners that are included on the mask portions. In other embodiments, the nasal adhesive band 604 and/or the oral adhesive band 606 may include ferromagnetic metal particles, magnets, and/or other magnetic material throughout at least a portion the nasal adhesive band 604 and/or the oral adhesive band 606 rather than or in addition to the point-to-point fasteners such as the one or more mask fasteners 608 and/or 610.

Figure 6B:
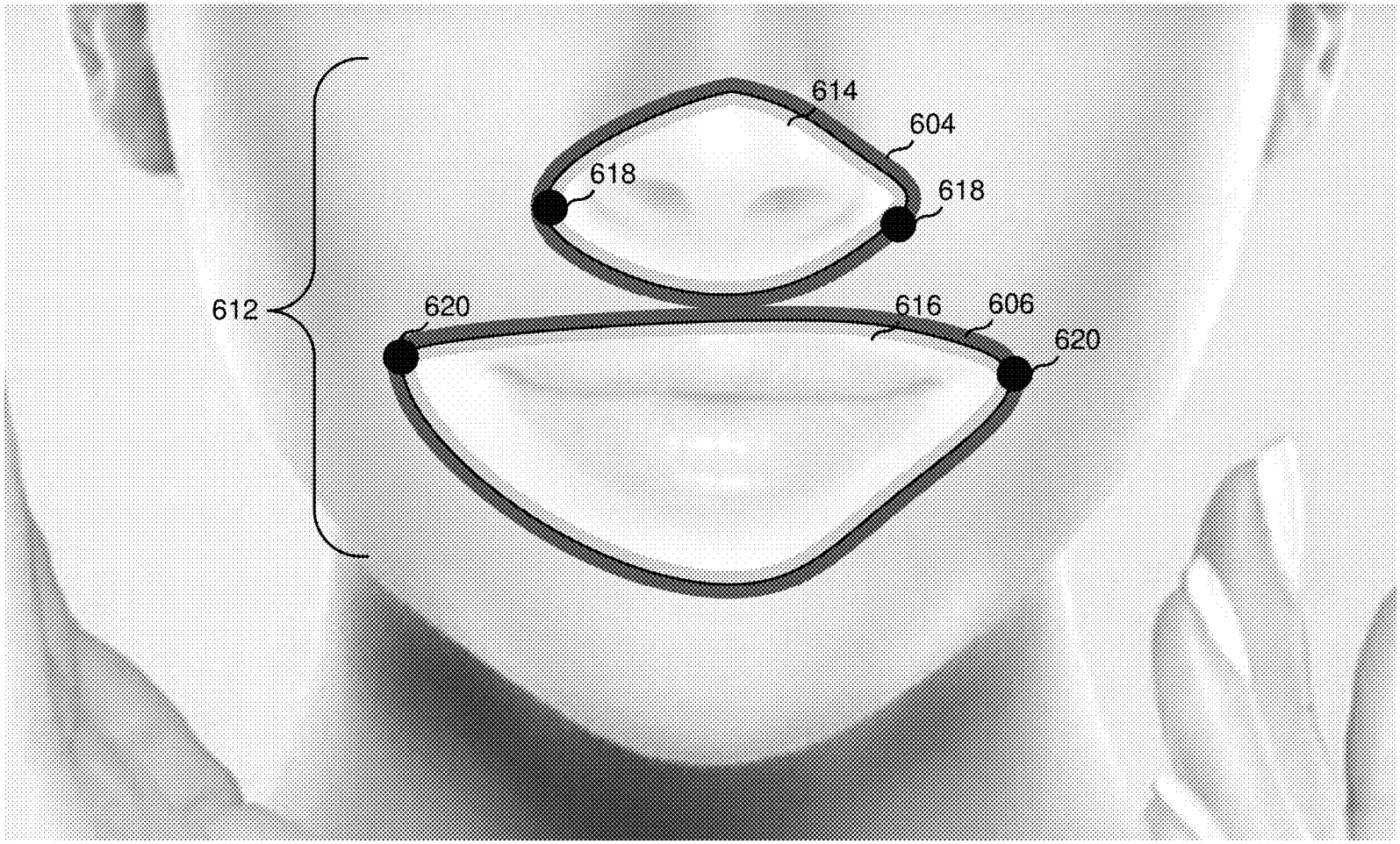
FIG. 6B is an illustration of an embodiment showing a variation that couples to the separate adhesive band of FIG. 6A.

FIG. 6B is an illustration of an embodiment showing a variation having adhesive band fasteners that couple to the mask fasteners 608 and 610 of FIG. 6A. As illustrated there, a two-part mask 612, which may be any of the two-part masks 102, 202, 302, and/or 502 described above, includes a nasal portion 614 that includes one or more adhesive band fasteners 618 that are configured couple to the one or more mask fasteners 608 included on the nasal adhesive band 604. The two-part mask 612 may also include an oral portion 616 that includes one or more adhesive band fasteners 620 that are configured to couple to the mask fasteners 610 include on the oral adhesive band 606. For example, the one or more adhesive band fasteners 618 and/or 620 may include a ferromagnetic metal particle, a magnet, and/or other magnetic material that may generate an attractive magnetic force with the corresponding mask fastener 608 and/or 610 on the underlying nasal adhesive band 604 and/or the oral adhesive band 606. However, the one or more adhesive band fasteners 618 and 620 may include other fasteners such as clips, screws, hook- and loop-fasteners, and/or other fasteners that couple with corresponding mask fasteners 608 and 610. In other embodiments, the nasal portion 614 and/or the oral portion 616 may include ferromagnetic metal particles, magnets, and/or other magnetic material throughout at least a portion the nasal portion 614 and/or the oral portion 616 that interfaces with the nasal adhesive band 604 and/or the oral adhesive band 606 rather than or in addition to the point-to-point fasteners such as the one or more adhesive band fasteners 618 and/or 620. Furthermore, in various embodiments, the force required to separate the nasal portion 614 from the nasal adhesive band 604 and/or the force required to separate the oral portion 616 from the oral adhesive band 606 should be less than the force required to remove the nasal adhesive band 604 and/or the oral adhesive band 606 from the face of the wearer.

A novel two-part mask assembly has now been described. The use of examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

Further embodiments can be envisioned to one of ordinary skill in the art after reading this disclosure. In other embodiments, combinations or sub-combinations of the above-disclosed invention can be advantageously made. The example arrangements of components are shown for purposes of illustration and combinations, additions, re-arrangements, and the like are contemplated in alternative embodiments of the present invention. Thus, while the invention has been described with respect to exemplary embodiments, one skilled in the art will recognize that numerous modifications are possible. The specification and drawings are, accordingly, to be regarded in an illustrative rather than a restrictive sense. It will, however, be evident that various modifications and changes may be made thereunto without departing from the broader spirit and scope of the invention as set forth in the claims and that the invention is intended to cover all modifications and equivalents within the scope of the following claims.

All references, including publications, patent applications, and patents, cited herein are hereby incorporated by reference to the same extent as if each reference were individually and specifically indicated to be incorporated by reference and were set forth in its entirety herein.

What is claimed is:

1. A two-part mask, comprising:

a nasal portion, wherein the nasal portion includes at least one nasal adhesive band fastener applied to a first filter such that the first filter is configured to enclose nostrils of a wearer when the nasal portion is applied to a nose of the wearer;

an oral portion, wherein the oral portion includes at least one oral adhesive band fastener applied to a second filter such that the second filter is configured to enclose a mouth of the wearer when the oral portion is applied to the mouth of the wearer;

a nasal adhesive band, wherein a first adhesive is applied to a first surface of the nasal adhesive band such that the first adhesive is configured to form a first enclosing seal between skin of the wearer and the nasal adhesive band and adhere the first surface of the nasal adhesive band to the skin when the nasal adhesive band is applied around the nose of the wearer, wherein a second surface of the nasal adhesive band that is opposite the nasal adhesive band from the first surface of the nasal adhesive band includes at least one first mask fastener that is configured to couple to the at least one nasal adhesive band fastener included on the first filter, and wherein the first adhesive and a coupling of the at least one first mask fastener with the respective at least one nasal adhesive band fastener are configured such that a first force required to separate the at least one first mask fastener from the at least one nasal adhesive band fastener is less than a second force required to remove the nasal adhesive band from the skin of the wearer such that the nasal portion is replaceable without having to remove the nasal adhesive band from the skin of the wearer when the nasal adhesive band forms the first enclosing seal; and an oral adhesive band, wherein a second adhesive is applied to a first surface of the oral adhesive band such that the second adhesive is configured to form a second enclosing seal between the skin of the wearer and the oral adhesive band and adhere the first surface of the oral adhesive band to the skin when the oral adhesive band is applied around the mouth of the wearer, wherein a second surface of the oral adhesive band that is opposite the oral adhesive band from the first surface of the oral adhesive band includes at least one second mask fastener that is configured to couple to the at least one oral adhesive band fastener included on the second filter, and wherein the second adhesive and a coupling of the at least one second mask fastener with the respective at least one oral adhesive band fastener are configured such that a third force required to separate the at least one second mask fastener from the at least one oral adhesive band fastener is less than a fourth force required to remove the oral adhesive band from the skin of the wearer such that the oral portion is replaceable without having to remove the oral adhesive band from the skin of the wearer when the nasal adhesive band forms the second enclosing seal.

2. The two-part mask of claim 1, wherein the first filter defines at least one first opening and the second filter defines at least one second opening.

3. The two-part mask of claim 2, wherein the at least one first opening is configured to receive at least one nostril device.

4. The two-part mask of claim 2, wherein the at least one second opening is configured to receive at least one oral device.

5. The two-part mask of claim 2, further comprising:

at least one first removable and reusable cover that is configured to be positioned over the at least one first opening and that provides a first airtight seal when positioned over the at least one first opening; and at least one second removable and reusable cover that is configured to be positioned over the at least one second opening and that provides a second airtight seal when positioned over the at least one second opening.

6. The two-part mask of claim 1, wherein the second filter of the oral portion includes a filter material and a transparent nonfilter material, wherein the transparent nonfilter material is positioned to allow for external viewing of lip movements of the wearer.

7. The two-part mask of claim 1, wherein the at least one first mask fastener includes a first ferromagnetic metal particle or a first magnet that is provided throughout the nasal adhesive band and the at least one nasal adhesive band fastener includes a second magnet configured to couple with the first ferromagnetic metal particle or a second ferromagnetic metal particle that is configured to couple with the first magnet, wherein the second magnet or the second ferromagnetic metal particle is provided throughout the nasal portion.

8. The two-part mask of claim 1, wherein the at least one second mask fastener includes a first ferromagnetic metal particle or a first magnet that is provided throughout the oral adhesive band and the at least one oral adhesive band fastener includes a second magnet configured to couple with the first ferromagnetic metal particle or a second ferromagnetic metal particle that is configured to couple with the first magnet, wherein the second magnet or the second ferromagnetic metal particle is provided throughout the oral portion.

9. The two-part mask of claim 1, wherein the at least one first mask fastener is distributed throughout at least a portion of the second surface of the nasal adhesive band, and wherein the at least one second mask fastener is distributed throughout at least a portion of the second surface of the oral adhesive band.

* * * * *